United States Patent [19]

Bakula

[11] 3,988,811

[45] Nov. 2, 1976

[54] BELT BUCKLE

[76] Inventor: Melvin S. Bakula, 8541 Lowell Blvd., Westminster, Colo. 80030

[22] Filed: June 30, 1975

[21] Appl. No.: 591,931

[52] U.S. Cl. ..... 24/186; 24/176
[51] Int. Cl.[2] ..... A44B 11/22
[58] Field of Search ..... 24/186, 176, 79, 182

[56] References Cited

UNITED STATES PATENTS

| | | | |
|---|---|---|---|
| 1,729,578 | 9/1929 | Gogan | 24/186 |
| 1,772,886 | 8/1930 | Critchley | 24/186 |
| 2,219,674 | 10/1940 | Zola | 24/182 |
| 2,419,662 | 4/1947 | Sutton | 24/186 |
| 2,495,029 | 1/1950 | Spengler | 24/182 |

FOREIGN PATENTS OR APPLICATIONS

| | | | |
|---|---|---|---|
| 37,795 | 6/1909 | Austria | 24/176 |

*Primary Examiner*—Bernard A. Gelak
*Attorney, Agent, or Firm*—Bertha L. MacGregor

[57] ABSTRACT

The belt buckle embodying this invention is composed of the handle, shank and tines of a table fork. The face member of the buckle is the fork handle, and the fork shank is curved to place the tine portion of the fork rearwardly of the face member. If a conventional four tine fork is employed for making the buckle, the two outer tines are bent to form a loop for attachment to one end of a belt strap, and the two center tines are joined at their free ends and bent to provide a hook adapted to engage a hole in the other end of the belt strap. Thus an integral one piece belt buckle is produced by utilizing an entire table fork.

3 Claims, 6 Drawing Figures

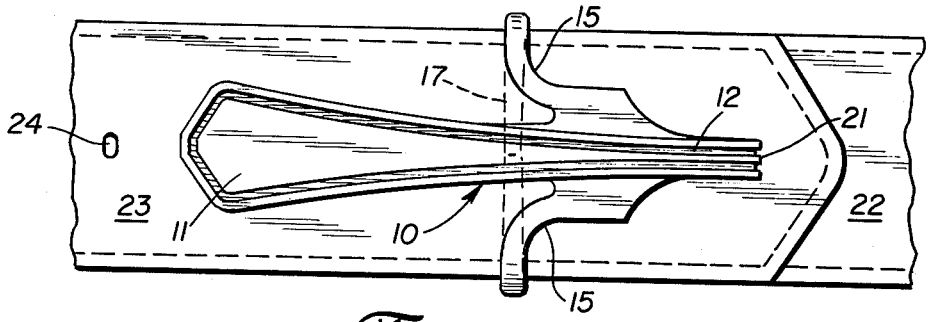
Fig. 1
Fig. 2
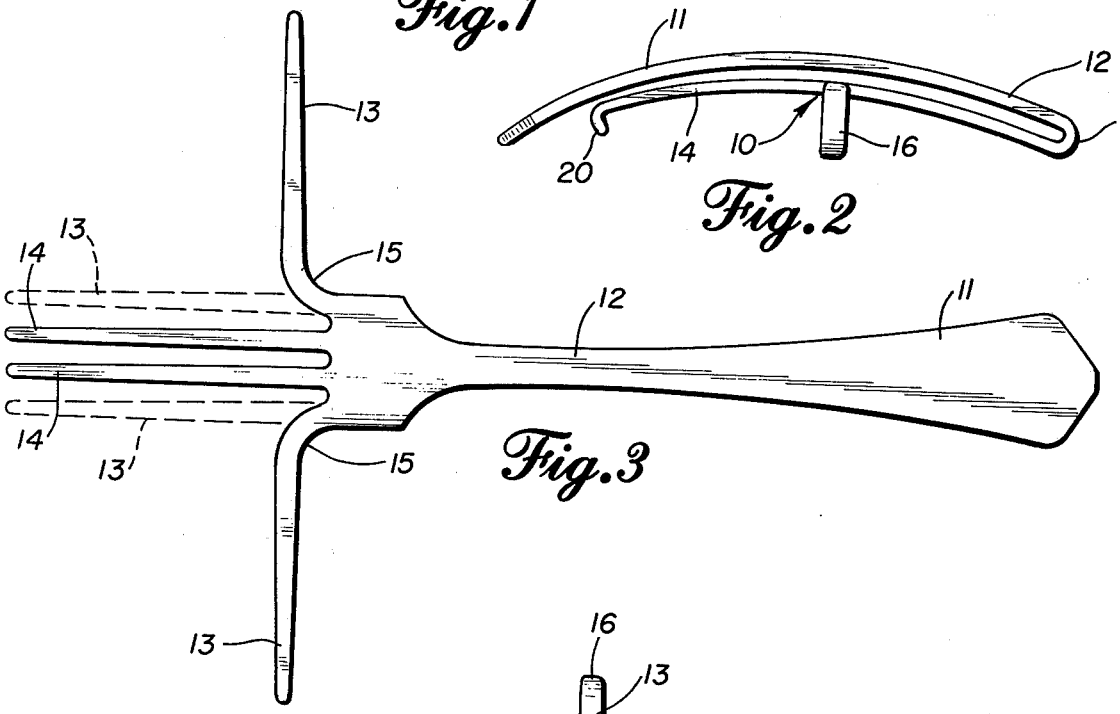
Fig. 3
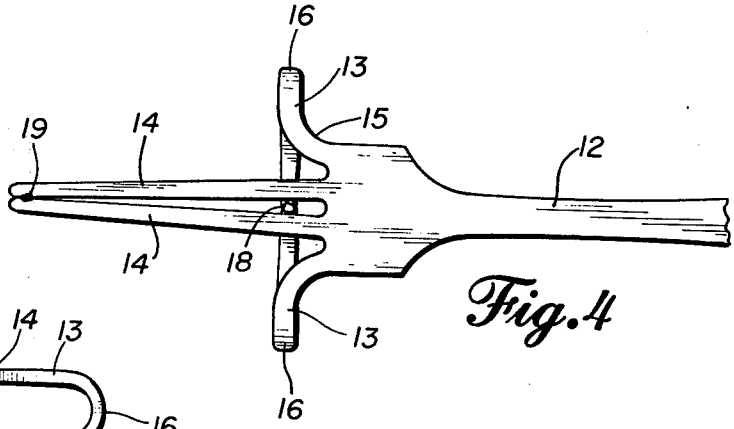
Fig. 4
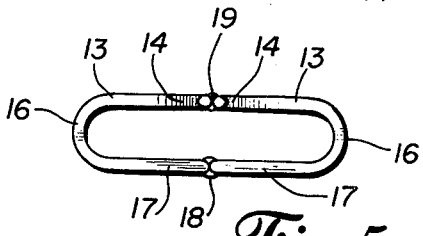
Fig. 5
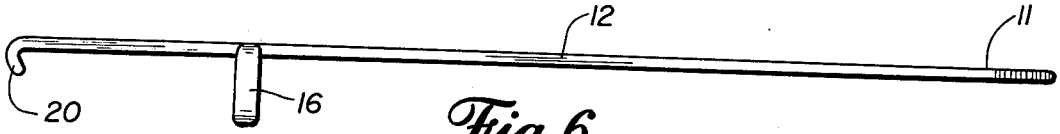
Fig. 6

BELT BUCKLE

BACKGROUND OF THE INVENTION

This invention relates to a belt buckle for connecting the two ends of a belt strap. The buckle is a one piece device composed of the handle, shank and tines of a common table fork. Heretofore parts of table spoons and tea spoons, i.e., the handles and shanks, have been utilized in the manufacture of jewelry, such as bracelets, but it is believed to be new in the art to produce jewelry or belt buckle embodying an entire table fork.

SUMMARY OF THE INVENTION

The belt buckle of this invention is composed of the handle, shank and tines of a common table fork. The fork handle is the face member of the buckle, and the fork shank is bent to dispose the tine portion of the fork rearwardly of the face member. Most table forks have four tines, as shown herein, but a three tine fork would serve equally well. The two outer tines are bent to form a loop extending rearwardly from the tine portion, said loop being adapted for attachment to one end of a belt strap. The center tines are joined together at their free ends and bent to form a hook for detachably engaging a hole in the opposite end of the belt strap.

OBJECTS OF THE INVENTION

The object of the invention is to provide a one piece belt buckle by utilizing an entire table fork, to thereby produce a useful, attractive in appearance article, from one which may have been discarded as part of a tableware set.

DRAWINGS

FIG. 1 is a front elevational view of the belt buckle embodying this invention.

FIG. 2 is a side elevational view of the same.

FIG. 3 is a plan view of a table fork from which the belt buckle is made, showing two outer tines of the four tine fork bent outwardly at ninety degree angles, preparatory to further curving and bending the two tines to form a loop.

FIG. 4 is a top view of the fork showing the outer tines bent and curved to form a loop and two center tines joined at their free ends.

FIG. 5 is an end elevational view of the fork of FIG. 4.

FIG. 6 is a side elevational view of the fork showing the two center tines bent into a hook end and the outer tines in the loop form of FIG. 4.

DESCRIPTION OF THE PREFERRED EMBODIMENT

In the embodiment of the invention shown in the drawings, the belt buckle 10 comprises the fork handle 11, fork shank 12, and tines including two outer tines 13 and center tines 14. The fork handle 11 constitutes the face member of the buckle, the shank 12 being bent to place the tine portion of the fork rearwardly of the face member. The outer tines 13 are first bent outwardly at 90° angles as shown at 15 in FIG. 3, and then bent rearwardly at 16 relatively to the face member and inwardly toward each other at 17 to form a loop. The meeting ends of the parts 17 of the tines 13 are welded at 18 to complete the loop.

The center tines 14 of the fork are drawn toward each other and welded together at 19 and bent to form a hook 20 at the free end of the joined tines.

The steps of the method for converting a table fork into a belt buckle according to this invention preferably are as follows: bend two outer tines 13 outwrdly 90°; bend two center tines 14 toward each other and weld at 19; bend the two outer tines 13 from their 90° positions by forming the curves 16 and the inturned portions 17 into a loop; trim tips of portions 17 to make them meet and apply solder 18 to complete loop; form hook 20 on welded center tines 14; and bend shank at 21 between handle 11 and tine portion to locate the loop and the hook members rearwardly of the buckle face member.

The loop member serves for attachment to one end 22 of a belt strap. The opposite end 23 is provided with holes for selective engagement by the hook 20 of the buckle.

Practically all table forks are four tined, but a three tine fork could be substituted for the one described and shown herein, and in that case the single center tine would function to carry the hook 20 on its end and welding together of two center tines such as tines 14 would be eliminated. Most table forks are curved slightly in longitudinal directions in their handle and shank areas, so that the outer surface of the front member of the buckle is slightly convex, which is desirable for fitting the buckle to the wearer, but if greater curvature is desired the fork handle and shank may be altered in this respect.

I claim:

1. A one piece belt buckle embodying a table fork comprising an integral handle, shank and plurality of tines extending longitudinally, said buckle comprising a. a face member formed by the handle, part of said shank of said fork bent to underlie the face member, b. belt engaging means consisting of two of said table fork tines extending laterally and underneath said face member and extending rearwardly near the junction of the tines and shank to form a loop-like configuration for receiving a belt, and c. a hook member on another tine of said fork for engaging a hole in a belt.

2. The belt buckle defined by claim 1, in which the table fork is a four tined fork, the belt engaging means is formed by two outer tines of the said fork, and the hook member is located at the end of the center tines of said fork.

3. The belt buckle defined by claim 1, in which the belt engaging means is a loop extending rearwardly from the tine portion of the said fork.

* * * * *